US011703024B2

(12) United States Patent
Mizoguchi

(10) Patent No.: US 11,703,024 B2
(45) Date of Patent: Jul. 18, 2023

(54) CONTROL DEVICE OF VEHICLE

(71) Applicant: TOYOTA JIDOSHA KABUSHIKI KAISHA, Toyota (JP)

(72) Inventor: Hiroaki Mizoguchi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/822,908

(22) Filed: Aug. 29, 2022

(65) Prior Publication Data

US 2023/0129229 A1 Apr. 27, 2023

(30) Foreign Application Priority Data

Oct. 27, 2021 (JP) ..... 2021-175353

(51) Int. Cl.
*F02N 11/04* (2006.01)
*F02D 41/06* (2006.01)

(52) U.S. Cl.
CPC ..... *F02N 11/04* (2013.01); *F02D 41/068* (2013.01); *F02D 2200/021* (2013.01); *F02D 2200/0414* (2013.01); *F02D 2200/50* (2013.01)

(58) Field of Classification Search
CPC .. F02N 11/04; F02D 41/068; F02D 2200/021; F02D 2200/0414; F02D 2200/50
See application file for complete search history.

(56) References Cited

U.S. PATENT DOCUMENTS

2016/0230680 A1* 8/2016 DeMarco ..... F02P 5/1504
2018/0037178 A1* 2/2018 Richardson ..... B60R 16/033
2018/0334158 A1* 11/2018 Chen ..... B60W 10/30
2019/0063393 A1* 2/2019 Smith ..... B61C 17/00
2020/0165987 A1* 5/2020 Cunningham ..... B60W 20/00

FOREIGN PATENT DOCUMENTS

JP 2014-136535 A 7/2014
WO WO-2017051155 A2 * 3/2017 ..... F01M 5/00
WO WO-2017051156 A1 * 3/2017 ..... F01M 5/001
WO WO-2019141612 A1 * 7/2019 ..... F02N 11/006

* cited by examiner

*Primary Examiner* — Joseph J Dallo

(74) *Attorney, Agent, or Firm* — Oblon, McClelland, Maier & Neustadt, L.L.P.

(57) ABSTRACT

Provided is a control device of a vehicle including an alternator that generates power using a driving force of an internal combustion engine, wherein when the alternator is cold and a request power of an accessory is equal to or greater than a predetermined value, the control device increases the number of revolutions of the internal combustion engine compared with the number of revolutions when the alternator is not cold.

4 Claims, 4 Drawing Sheets

CONTROL DEVICE OF VEHICLE

CROSS-REFERENCE TO RELATED APPLICATION

This application is based upon and claims the benefit of priority of the prior Japanese Patent Application No. 2021-175353, filed on Oct. 27, 2021, the entire contents of which are incorporated herein by reference.

FIELD

The present disclosure relates to a control device of a vehicle.

BACKGROUND

Accessories such as an air conditioner are installed in a vehicle. When many accessories are operated, the load on the battery increases. The power is generated and the battery can be charged by driving the alternator with the power of the internal combustion engine, as disclosed in, for example, Japanese Patent Application Publication No. 2014-136535.

SUMMARY

The efficiency of the alternator improves during a cold state, and the current generated by the alternator increases. However, the torque of the alternator also increases. As the torque increases, the stress applied to the components such as a decoupler increases, and the durability of the components may decrease. As the number of revolutions of the internal combustion engine is increased, the number of rotations of the alternator increases, and the torque of the alternator decreases. The decrease in torque reduces the load on the components. However, increasing of the number of revolutions lowers fuel economy. Therefore, the objective of the present disclosure is to provide a control device of a vehicle capable of protecting components and inhibiting the fuel economy from lowering.

The above objective is achieved by a control device of a vehicle including an alternator that generates power using a driving force of an internal combustion engine, wherein when the alternator is cold and a request power of an accessory is equal to or greater than a predetermined value, the control device increases the number of revolutions of the internal combustion engine compared with the number of revolutions when the alternator is not cold.

When the request power of the accessory becomes less than the predetermined value, the control device may decrease the number of revolutions of the internal combustion engine compared with the number of revolutions when the alternator is cold.

When a driving time of the internal combustion engine becomes equal to or greater than a predetermined time, the control device may decrease the number of revolutions of the internal combustion engine compared with the number of revolutions when the alternator is cold.

The predetermined time may be determined based on a temperature of cooling water of the internal combustion engine and a temperature of intake-air.

DETAILED DESCRIPTION

Figure 1A:
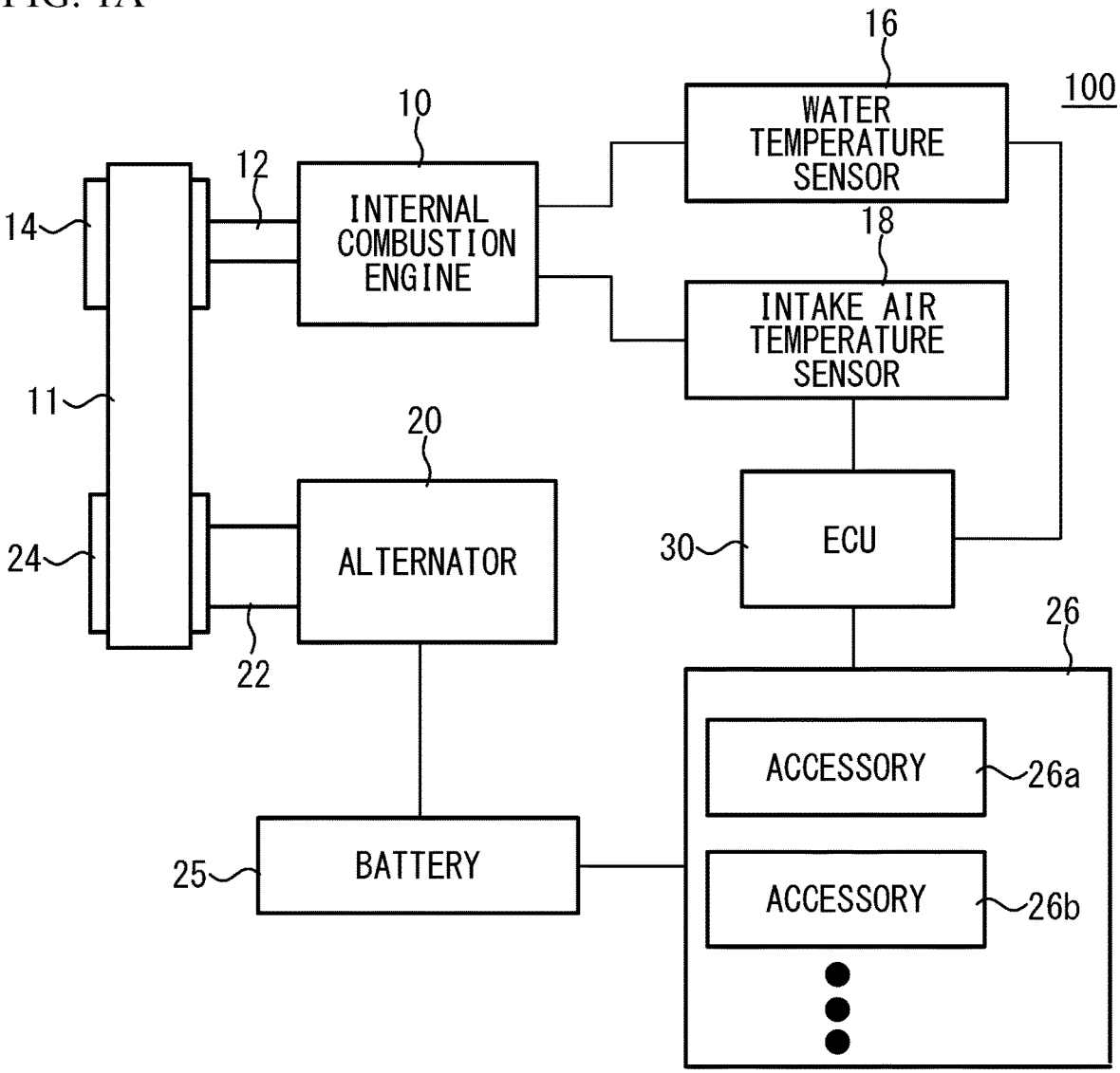
FIG. 1A is a schematic view illustrating a vehicle in accordance with an embodiment.

Hereinafter, a description will be given of a control device of a vehicle of a present embodiment with reference to the accompanying drawings. FIG. 1A is a schematic view illustrating a vehicle 100 in accordance with an embodiment. As illustrated in FIG. 1A, the vehicle 100 includes an internal combustion engine 10, an alternator 20, and an electronic control unit (ECU) 30.

The internal combustion engine 10 is, for example, a gasoline engine. Fuel combustion in the combustion chamber of the internal combustion engine 10 causes a crankshaft 12 to rotate. The crankshaft 12 of the internal combustion engine 10 is coupled to a pulley 14. As the crankshaft 12 rotates, the pulley 14 also rotates.

Figure 1B:
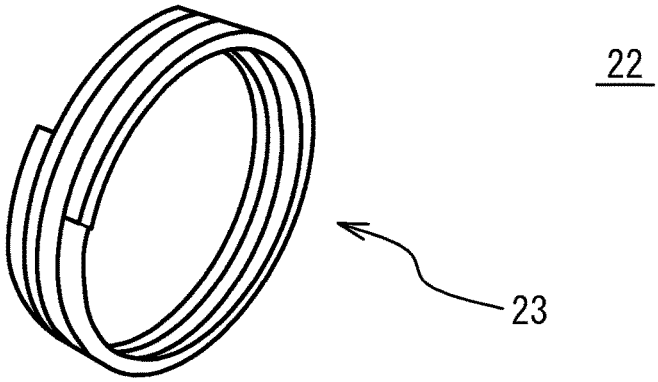
FIG. 1B is a perspective view illustrating the coil spring of a decoupler.

The alternator 20 and the internal combustion engine 10 are accommodated in the engine compartment. The alternator 20 is a power generator, and is coupled to a pulley 24. The alternator 20 is equipped with a decoupler 22. FIG. 1B is a perspective view illustrating a coil spring 23 of the decoupler 22. As illustrated in FIG. 1B, the decoupler 22 includes the coil spring 23. The coil spring 23 is wound in the rotation direction of the pulley 24. The regulator provided in the alternator 20 controls the efficiency of the alternator 20 according to the temperature.

A water temperature sensor 16 detects the temperature of the cooling water of the internal combustion engine 10. An intake air temperature sensor 18 detects the temperature of the air introduced into the internal combustion engine 10. Accessories 26 are electrical devices installed in the vehicle 100, and include accessories 26*a*, 26*b*, . . . . Examples of the accessories 26 include, but are not limited to, the PTC heater of the air conditioner, a de-icer (EWH, electric heated windshield), a seat heater, and headlights. A battery 25 is a secondary batter that can be charged and discharged. The electric power output from the battery 25 drives the accessories 26.

Figure 2:
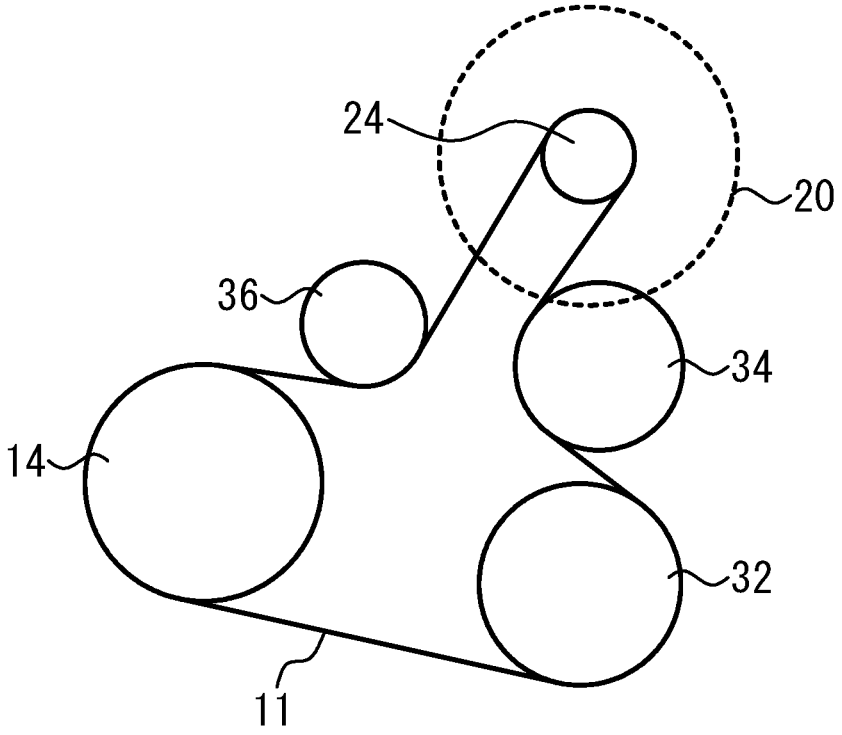
FIG. 2 is a front view illustrating a pulley.

FIG. 2 is a front view illustrating a pulley. A belt 11 is installed over the pulley 14, the pulley 24, and a pulley 32. The pulleys 14, 24, and 32 and tensioners 34 and 36 are disk shaped. The pulley 14 is coupled to the crankshaft 12 of the internal combustion engine 10 (see FIG. 1A). The pulley 24 is coupled to the alternator 20. The pulley 32 is coupled to one of the accessories 26, such as an air conditioner.

A first face of the belt 11 is in contact with the outer peripheries of the pulleys 14, 24, and 32. The contact of the tensioners 34 and 36 with a second face of the belt 11 inhibits the slack of the belt 11 and keeps the belt 11 taut.

The driving force of the internal combustion engine 10 is transmitted to the alternator 20 by the belt 11 and the pulleys. As the crankshaft 12 of the internal combustion engine 10 rotates, the pulley 14 rotates. The force is transmitted to the pulleys 24 and 32 by the belt 11, and the pulleys 24 and 32 also rotate. As the pulley 24 rotates, the rotor (not illustrated) of the alternator 20 rotates, and the alternator 20 generates power. The generated power is used to charge the battery 25, for example.

The ECU 30 illustrated in FIG. 1A is a control device that includes an arithmetic device, such as a central processing unit (CPU), and storage devices such as a flash memory, a read only memory (ROM), and a random access memory (RAM), and performs various controls by executing programs stored in the storage device.

The ECU 30 obtains the water temperature detected by the water temperature sensor 16, and the intake-air temperature detected by the intake air temperature sensor 18. The ECU 30 obtains the state of charge (SOC) of the battery 25, and controls the output of the battery 25 and the like. The ECU 30 controls the output of the battery 25 according to the request power (e.g., the request current) of the accessories 26, for example. During cold start, to drive the de-icer, the heater, and the like, the request power of the accessories 26 is high compared with the request power during a non-cold state. The ECU 30 sets the output power of the battery 25 high.

The ECU 30 controls the number of revolutions of the internal combustion engine 10 to control the number of rotations of the alternator 20. As the number of revolutions of the internal combustion engine 10 increases, the number of rotations of the alternator 20 increases. As the number of revolutions of the internal combustion engine 10 decreases, the number of rotations of the alternator 20 decreases. During the idling of the internal combustion engine 10, the ECU 30 may set the number of revolutions of the internal combustion engine 10 high (idle-up). The increase in the number of revolutions of the internal combustion engine 10 results in the increase in the number of rotations of the alternator 20.

For example, during cold start, electric devices such as the de-icer and the PCT heater are turned on. Thus, the request power of the accessories 26 is high compared with the request power during a non-cold state. The ECU 30 sets the output power of the battery 25 high. The power is generated by the alternator 20 and the battery 25 is charged so that the power of the battery 25 is not run out.

Figure 3A:
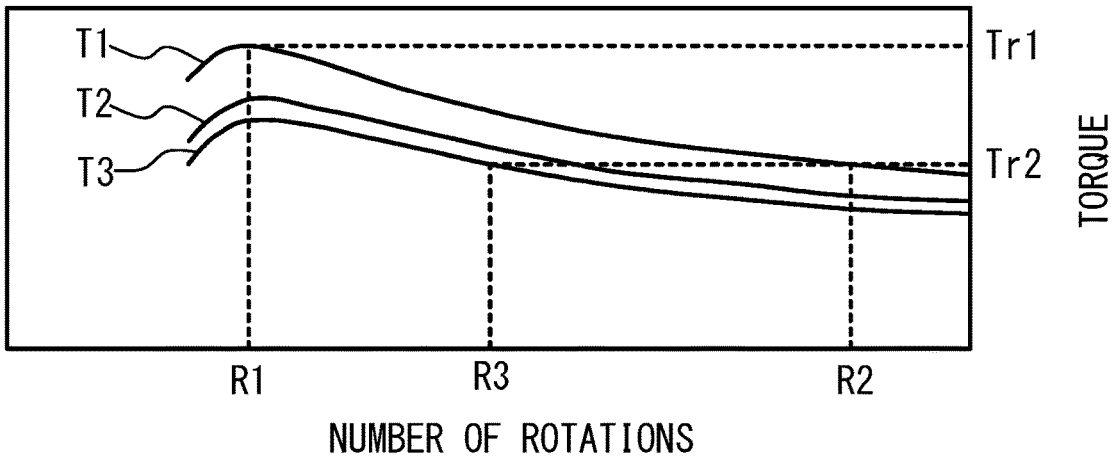
FIG. 3A illustrates the torque of an alternator.

FIG. 3A illustrates the torque of the alternator 20. The horizontal axis represents the number of rotations of the alternator 20. The vertical axis represents the torque of the alternator 20. Among the temperatures T1, T2, and T3, the temperature T1 is the lowest. The temperature T2 is higher than T1, and is lower than T3. The temperature T3 is the highest.

The regulator provided in the alternator 20 controls the efficiency of the alternator 20 according to the temperature. When the temperature of the alternator 20 is low, the efficiency of the alternator 20 improves compared with that when the temperature is high, and the generated current increases. As the generated current increases, the torque that rotates the alternator 20 increases. For example, as illustrated in FIG. 3A, at the same number of rotations, the torque at the temperature T1 is higher than the torque at the temperature T2. The torque at the temperature T2 is higher than the torque at the temperature T3.

During a cold state, the current generated by the alternator 20 increases, and the torque of the alternator 20 also increases. As the torque increases, the mechanical load on the decoupler 22 increases. To reduce the load on the decoupler 22, it is only required to reduce the torque.

Figure 3B:
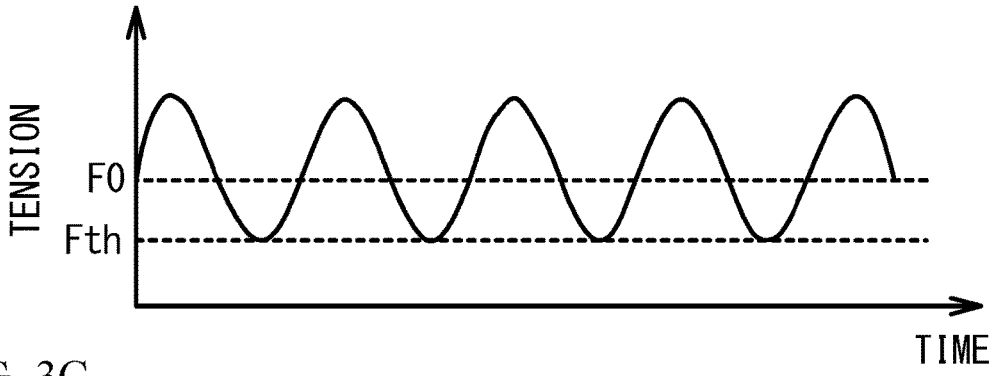
FIG. 3B illustrates a belt tension.

FIG. 3B illustrates the tension of the belt 11. The horizontal axis represents time. The vertical axis represents tension. The tension of the belt 11 varies with time, and alternately varies between the tension higher than the tension F0, which is the tension when the belt 11 is installed, and the tension lower than F0. When the tension becomes lower than Fth, the belt 11 slips on the surface of the pulley, and the rotative force is less likely to be transmitted. As the torque of the alternator 20 increases, the amount of change in the tension of the belt 11 increases. That is, the amplitude in FIG. 3B increases, and becomes less than the threshold value Fth, and the belt may slip. To inhibit the belt slip, it is effective to reduce the torque of the alternator 20 to reduce the amount of change in the tension of the belt 11.

As described above, to reduce the load on the decoupler 22 and inhibit the belt slip, it is only required to reduce the torque of the alternator 20. As illustrated in FIG. 3A, at the same temperature (e.g., T1), the torque is reduced by increasing the number of rotations. By performing idle-up that increases the number of revolutions during the idling of the internal combustion engine 10, the number of rotations of the alternator 20 also increases, and the torque can be reduced.

Figure 3C:
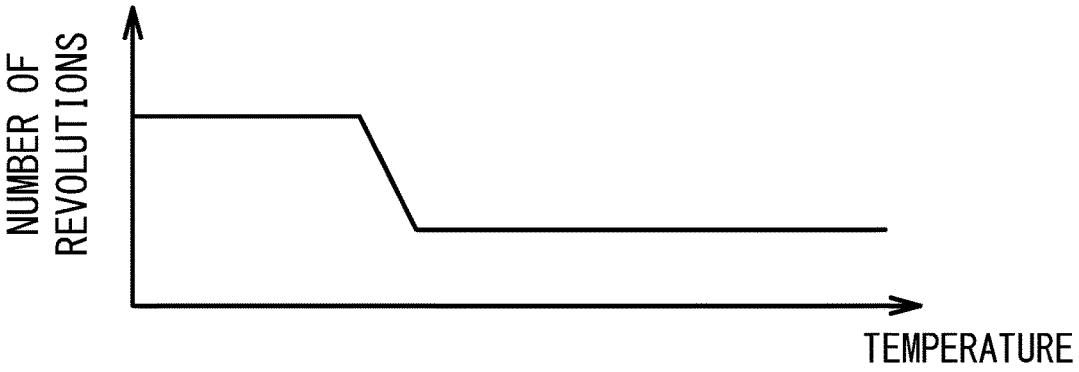
FIG. 3C illustrates the number of revolutions.

FIG. 3C is a diagram illustrating the number of revolutions. The horizontal axis represents temperature (for example, the temperature of the cooling water). The vertical axis represents the number of revolutions. When the water temperature is low, the temperature of the alternator 20 is low. The efficiency of the alternator 20 is high, and the torque is also high. As illustrated in FIG. 3C, when the water temperature is low, the number of revolutions is set higher than that when the water temperature is high. As illustrated in FIG. 3A, as the number of rotations increases, the torque decreases.

However, when the number of revolutions of the internal combustion engine 10 is increased, the fuel economy lowers. In addition, shifting from idling to driving may give the passenger feeling that the vehicle jumps out (jump-out feeling). The present embodiment limits the opportunities for idle-up to achieve both the reduction in torque and inhibition of lowering of the fuel economy.

Figure 4:
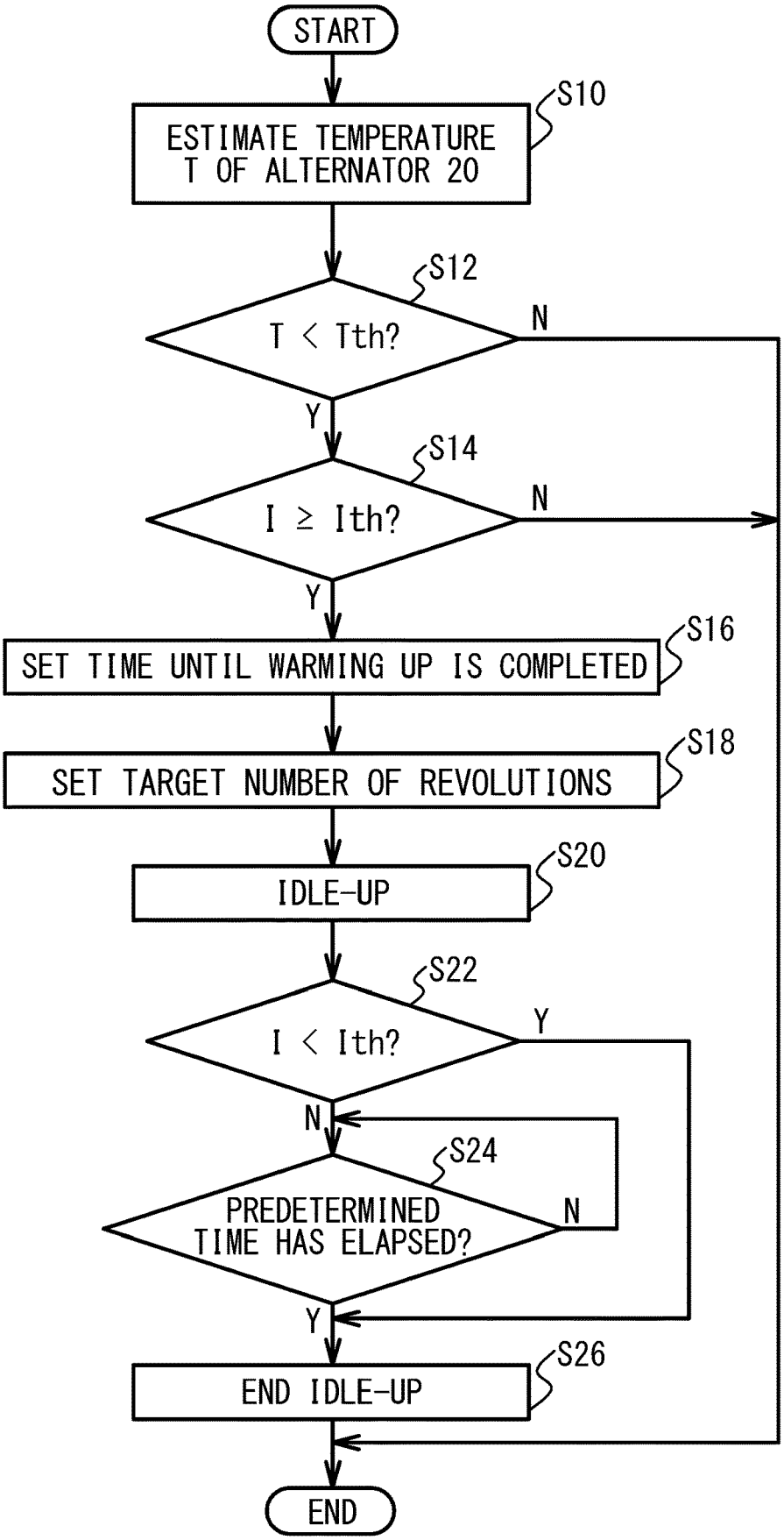
FIG. 4 is a flowchart illustrating a process executed by an ECU.

FIG. 4 is a flowchart illustrating a process executed by the ECU 30. The ECU 30 estimates the temperature T of the alternator 20 on the basis of, for example, the water temperature and the intake-air temperature (step S10). The ECU 30 determines whether the temperature T is less than the threshold value Tth (step S12). When the determination is No, the alternator 20 is in a non-cold state. In this case, the process ends. When the determination is Yes, the alternator 20 is in a cold state.

The ECU 30 determines whether the request current I is equal to or greater than the predetermined value (the threshold value Ith) (step S14). When many accessories 26 operate, the request current I is high. For example, when the electric devices such as the de-icer of the front windshield and the air conditioner are operated immediately after cold start, the request current I becomes high. When the determination is No, the process ends. When the determination is Yes, the ECU 30 sets the time until the warming up of the alternator 20 is completed (step S16). The ECU 30 determines the time according to the water temperature and the intake-air temperature at the time of starting the internal combustion engine 10, for example. When the water temperature and the intake-air temperature are high, the ECU 30 sets the time short. When the water temperature and the intake-air temperature are low, the ECU 30 sets the time long.

The ECU 30 sets the target number of revolutions for idle-up (step S18). As illustrated in FIG. 3C, the number of revolutions is determined on the basis of, for example, the temperature such as the water temperature. When the water temperature and the intake-air temperature are low, the ECU 30 sets the target number of revolutions higher than the target number of revolutions when the water temperature and the intake-air temperature are high.

The ECU 30 performs idle-up (step S20). More specifically, the ECU 30 increases the opening degree of the throttle valve to increase the number of revolutions of the internal combustion engine 10. Since the number of revolutions of the internal combustion engine 10 increases, the number of rotations of the alternator 20 also increases.

The ECU 30 determines whether the request current I is less than the threshold value Ith (step S22). When the determination is Yes, the ECU 30 ends idle-up (step S26). The number of revolutions of the internal combustion engine 10 decreases, and the number of rotations of the alternator 20 also decreases. The rotation of the alternator 20 may be stopped. After step S26, the process ends. For example, when the time elapses from cold start, the amount of heat generation of the de-icer and other devices is reduced compared with that immediately after start. This decreases the request current I of the accessories 26. Since the request current I is small, the usage of the SOC of the battery 25 decreases. Therefore, the alternator 20 may be stopped. When the SOC of the battery 25 becomes equal to or less than the predetermined value, the ECU 30 generates power by the alternator 20 to charge the battery 25.

When the determination is No in step S22, the ECU 30 determines whether the predetermined time (the time determined in step S16) has elapsed from the start of the internal combustion engine 10 (step S24). When the determination is No, step S24 is repeated. When the determination is Yes, the ECU 30 ends idle-up (step S26). After step S26, the process ends.

For example, it is assumed that the temperature immediately after cold start is the temperature T1 in FIG. 3A. When the number of rotations of the alternator 20 is increased from R1 to R2 by idle-up, the torque decreases from Tr1 to Tr2. Since the predetermined time elapses from the start of the internal combustion engine 10, the alternator 20 is warmed up, and the temperature increases from T1 to T3 (a non-cold state). At the temperature T3, the number of rotations corresponding to the torque Tr2 is R3. R3 is lower than R2. The ECU 30 ends idle-up and reduces the number of revolutions of the internal combustion engine 10 (step S26). This decreases the number of rotations of the alternator 20 from R2 to R3. Since the temperature of the alternator 20 increases, the number of revolutions can be reduced while the state in which the torque is low is maintained. The decrease in the number of revolutions inhibits the fuel economy of the internal combustion engine 10 from lowering.

In the present embodiment, the ECU 30 increases the number of revolutions of the internal combustion engine 10 (idle-up, step S20 in FIG. 4) when the alternator 20 is cold and the request power (the request current I) of the accessories 26 is equal to or greater than the predetermined value Ith. Since the number of revolutions of the internal combustion engine 10 increases, the number of rotations of the alternator 20 also increases. As illustrated in FIG. 3A, as the number of rotations of the alternator 20 increases, the torque decreases. Since the torque decreases, the loads on the components such as the decoupler 22 installed in the alternator 20 are reduced, and the reduction in the durability of the components can be inhibited. Since the tension of the belt 11 decreases, the slip of the belt 11 is inhibited.

When the request current I is less than the threshold value Ith, idle-up is not performed (step S12 in FIG. 4). By limiting the opportunities for idle-up on the basis of the request current I, the fuel economy can be inhibited from lowering and the torque can be reduced. In addition, throwing-forward feeling when the brake is off can be reduced.

When the request current I becomes less than Ith, the ECU 30 ends idle-up (steps S22 and S26). Since the request current I is small, it is not required for the alternator 20 to always generate power for charging the battery 25. When idle-up ends, and the number of revolutions of the internal combustion engine 10 decreases, the lowering of the fuel economy can be inhibited.

When the elapsed time from the start of the internal combustion engine 10 becomes equal to or greater than the predetermined time, the ECU 30 predicts that the warming up of the alternator 20 is completed, and ends idle-up (steps S24 and S26). As illustrated in FIG. 3A, as the temperature of the alternator 20 increases, the torque decreases. Therefore, even when the number of revolutions is reduced, the torque can be kept low. The reduction in torque and the inhibition of the lowering of the fuel economy can be both achieved.

The ECU 30 determines the time until the alternator 20 is warmed up on the basis of the water temperature and the intake-air temperature at the time of starting the internal combustion engine 10 (step S16). The alternator 20 is accommodated in the engine compartment together with the internal combustion engine 10. The temperature of the alternator 20 varies with the water temperature and the intake-air temperature. When the water temperature and the intake-air temperature increase, the temperature of the engine compartment also increases, and it is considered that the temperature of the alternator 20 also increases. Therefore, the time until the warming up is completed is determined on the basis of the water temperature and the intake-air temperature at the time of start. Since the temperature of the alternator 20 increases, the torque decreases. Even when the idle-up ends, the torque can be kept low. Therefore, the reduction in torque and the inhibition of the lowering of the fuel economy can be both achieved.

Although some embodiments of the present invention have been described in detail, the present invention is not limited to the specific embodiments but may be varied or changed within the scope of the present invention as claimed.

What is claimed is:

1. A control device of a vehicle including an alternator that generates power using a driving force of an internal combustion engine, wherein the internal combustion engine is coupled to a first pulley and the alternator is coupled to a second pulley, a belt is installed over the first pulley and the second pulley, power generated by the alternator is used to charge a battery, electric power output from the battery drives an accessory, when the alternator is cold and generates the power and a request power of the accessory is equal to or greater than a predetermined value, the control device increases the number of revolutions of the internal combustion engine compared with the number of revolutions when the alternator is not cold.

2. The control device of the vehicle according to claim 1, wherein when the request power of the accessory becomes less than the predetermined value, the control device decreases the number of revolutions of the internal combustion engine compared with the number of revolutions when the alternator is cold.

3. The control device of the vehicle according to claim 1, when a driving time of the internal combustion engine becomes equal to or greater than a predetermined time, the control device decreases the number of revolutions of the internal combustion engine compared with the number of revolutions when the alternator is cold.

4. The control device of the vehicle according to claim 3, wherein the predetermined time is determined based on a temperature of cooling water of the internal combustion engine and a temperature of intake-air.

* * * * *